US006871997B2

(12) United States Patent
Hartmann et al.

(10) Patent No.: US 6,871,997 B2
(45) Date of Patent: Mar. 29, 2005

(54) WATCH CASE

(75) Inventors: Olivier Hartmann, Châtelaine (CH); Alberto Jaussi, Petit-Lancy (CH); Daniel Moille, Yvoire (FR); William Passaquin, Armoy (FR)

(73) Assignee: Rolex S.A., Geneva (CH)

( * ) Notice: Subject to any disclaimer, the term of this patent is extended or adjusted under 35 U.S.C. 154(b) by 0 days.

(21) Appl. No.: 10/735,390

(22) Filed: Dec. 12, 2003

(65) Prior Publication Data

US 2004/0141424 A1 Jul. 22, 2004

(30) Foreign Application Priority Data

Dec. 20, 2002 (EP) ..... 02406123

(51) Int. Cl.[7] ..... G04B 37/00

(52) U.S. Cl. ..... 368/295; 368/281

(58) Field of Search ..... 368/88, 281, 294–295, 368/297–300

(56) References Cited

U.S. PATENT DOCUMENTS

| | | | | |
|---|---|---|---|---|
| 4,420,264 A | * | 12/1983 | Murata | 368/223 |
| 5,122,997 A | * | 6/1992 | Schneider et al. | 368/294 |
| 5,541,895 A | * | 7/1996 | Nussbaum | 368/295 |
| 5,654,941 A | * | 8/1997 | Joss | 368/295 |

FOREIGN PATENT DOCUMENTS

| | | |
|---|---|---|
| CH | 503 305 | 7/1970 |
| EP | 1139185 | 10/2001 |

* cited by examiner

*Primary Examiner*—Vit W. Miska
(74) *Attorney, Agent, or Firm*—Sturm & Fix LLP

(57) ABSTRACT

A watch case comprising a rotary bezel, first and second angular positioning markings, one set secured to the bezel and the other set to the case middle and elastic means in the form of a closed-loop spring tending to place the positioning markings into engagement with one another. These markings are distributed with numbers of spacings one of which is a multiple of the other and the outlines of which extend in a plane parallel to that of the bezel. Guide means are engaged with the markings having the smallest number of spacings, in order simultaneously to exert on these markings radial pressures directed toward the other markings.

34 Claims, 8 Drawing Sheets

WATCH CASE

CROSS REFERENCE TO RELATED APPLICATIONS

This application claims priority of European Application No. 02406123.6 filed Dec. 20, 2002, which is included in its entirety by reference made hereto.

BACKGROUND OF THE INVENTION

1. Field of the Invention

The present invention relates to a watch case comprising a case middle, a rotary bezel, first angular positioning markings secured to the case middle, second angular positioning markings secured to the rotary bezel and elastic means tending constantly to place said first and second positioning markings in engagement with one another.

2. Description of the Related Art

A great many watch cases comprising a bezel mounted so that it can be turned are known. Such a bezel bears one or more indications that can be placed as desired in an angular position chosen from several determined angular positions, fixed by angular positioning markings kept in engagement by elastic return means. Some of these bezels can rotate in both directions. In this case, one of the problems is to contrive for the force necessary to overcome the return force exerted on the angular positioning markings to be more or less equal in both directions. This force has also to give the user the feel of handling a mechanism that offers a certain resistance to movement, but which is then smooth once this resistance has been overcome and continues to move practically by itself as far as the next angular position.

EP 0 686 897 has already proposed a solution to this problem using a positioning spring working with an internal tooth set of the rotating bezel. This positioning spring has two straight segments connected by a bowed segment, the free end of one of the straight segments is kept in engagement with the tooth set of the bezel by a bearing surface secured to the case middle and the free end of the other straight segment is secured to this same case middle. The spring is shaped so that the forces exerted by the tooth set on its end engaged therewith, in both directions of rotation of the rotary bezel, serve to increase (or decrease) the radius of curvature of the bowed segment of the spring and allows balancing of the forces in the two directions in which the bezel rotates.

Also proposed, in EP 1 139 185, is a watch case with rotary bezel in which the rotary bezel can be moved selectively into two vertical positions determined by stop elements. In one of these vertical positions, the bezel is able to turn, whereas in the other vertical position it engages with toothed sectors of a fixed annual member which prevents it from turning and holds it in a determined angular position.

Also proposed, in CH 536 509, is a device for the angular positioning of a rotary bezel able to require equal forces in both directions in order to turn the bezel. For this, an edge tooth set with triangular teeth, formed under the bezel, collaborates with a piston mounted in a housing belonging to the case middle. When the two faces of the triangular edge teeth have equal inclinations, the forces needed to turn the bezel in both directions are equal. Given the presence of a piston that has to be housed in the case middle, this solution is not easy to implement given the space occupied.

BRIEF SUMMARY OF THE INVENTION

The object of the present invention is to provide a simple, reliable, long-life solution which therefore in practice experiences very little wear and can be fitted in such a way as to provide fine adjustment to the force needed to move the rotary bezel.

To this end, the subject of the invention is a watch case as defined by claim 1.

One of the essential advantages of this invention lies in the fact that the forces are not only equal in the two directions of rotation of the rotary bezel, in the case of a rotary bezel that can be turned in the two opposite directions, but are also balanced with respect to the axis of rotation of this bezel, and this contributes to the pleasant feel experienced in turning the bezel, allowing firmness of positioning and smoothness of movement. Hence, this solution can be put to good use even in solutions where the bezel can rotate in just one direction. This is because the firm positioning and the smoothness of movement can also be felt on a bezel able to be turned in just one direction.

The attached drawings schematically and by way of example illustrate three embodiments of the watch case that is the subject of this invention.

DETAILED DESCRIPTION OF THE INVENTION

Figure 1:
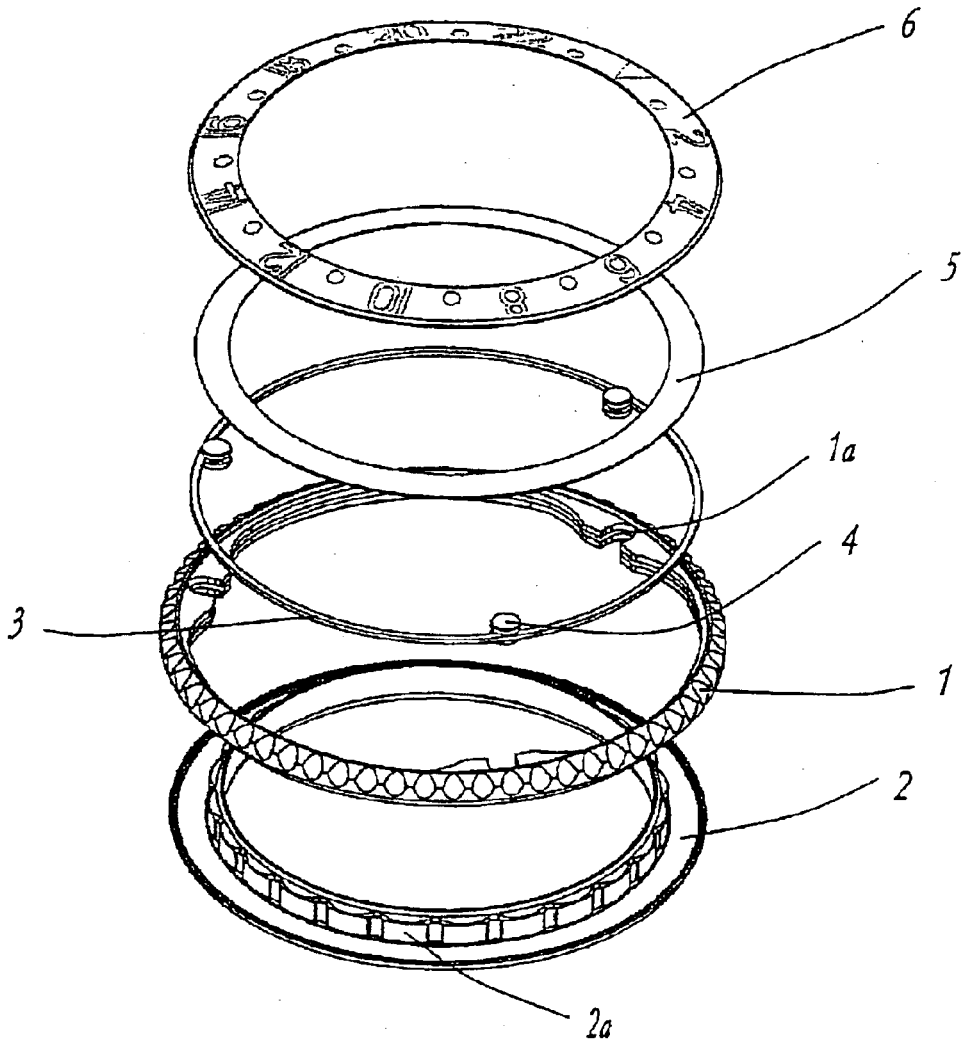
FIG. 1 is an exploded view of the elements of a watch case equipped with a rotary bezel, according to a first embodiment.

The attached drawings essentially illustrate the elements of the watch case that relate to the mechanism relating to a rotary bezel that is graduated or bears markings and can be moved into various angular positions with respect to a case middle B. The latter, which is not necessary for the understanding of the present invention, is depicted only partially in the view of FIG. 2 and in the corresponding sections in FIGS. 3 and 4.

The rotary bezel mechanism associated with the case middle B comprises a ring 2 the cross section of which is L-shaped. The vertical part of this L-shaped section is driven onto a cylindrical surface of the case middle B (FIGS. 3, 4) while the horizontal part of this L-section rests against a bearing surface of this case middle B. The outer face of the vertical part of the L-section of the ring 2 has first angular positioning markings 2*a*, the angular distances between which are equal, just like those of a tooth set, which are therefore secured to the case middle and whose profile, in plan view, forms a regular festoon. The shape of this festoon may be accentuated to a greater or lesser extent according to the desired characteristics for the movement of the rotary bezel 1 mounted on the ring 1 [sic]. In this example, these markings are 24 in number and therefore determine angular positions spaced 15° apart.

The rotary bezel 1 mounted on the ring 2 has, on the one hand, three radial guiding slides 1*a* spaced 120° apart and formed in three portions 1*b* which protrude into the rotary bezel 1. An annular slot 1*c* opens into the inside of the rotary bezel 1 and passes more or less through the center of the thickness of the three protruding portions 1*b*.

Each radial guiding slide 1*a* accommodates a roller 4 which comprises a groove 4*a* formed more or less at the middle of the roller 4 and coincides with the annular slot 1*c*. A spring 3 in the shape of a closed loop is placed in the annular slot 1*c*. This spring 3 surrounds the three rollers 4 and engages in their respective grooves 4*a*, holding these rollers 4 in the closed end of three of the first markings 2*a* spaced 120° apart, that is to say, in the example described, by an angle equal to 8 spacings, that is to say 8 markings. Simultaneous engagement of the closed-loop spring 3 in the annular slot 1*c* of the bezel 1 and in the grooves 4*a* of the rollers 4, secures these rollers 4 to the bezel 1 while at the same time allowing them to move in the radial guiding slides 1*a*.

These three rollers 4 constitute second angular positioning markings, secured in terms of rotation to the rotary bezel 1 by the radial slides 1*a*. The number of the fixed first angular markings 2*a* is therefore a multiple of the number of the second markings 4 of which there are at least three, so as to center the rotary bezel 1 with respect to the ring 2. By virtue of this relationship between the number of the first and second markings 2*a*, 4, the second markings 4 are simultaneously in mesh with three of the first markings 2*a* in each of the 24 positions defined by the 24 first angular positioning markings.

In these angular positions, the three angular positioning rollers 4 occupy the positions closest to the center of the rotary bezel 1 and the spring 3 is not deformed in this position, or is deformed very little. As soon as there is a desire to turn the rotary bezel 1, the three rollers 4 are moved away and made to move in a radial direction outward along their respective guiding slides 1*a*, the consequence of this being that of deforming the loop of the spring 3, giving it the shape of a three-sided figure with convex sides, as illustrated in chain line in FIG. 2. The profile of the lateral face between two angular positioning markings 2*a* forms a convex curve. As soon as the positioning rollers 4 have reached the respective crests of these convex curves separating two adjacent first angular positioning markings 2*a*, the force stored up as a result of the deformation of the spring 3 can be released, developing a turning moment that completes the movement of the rotary bezel 1 as far as the next first positioning marking 2*a*.

Figure 3:
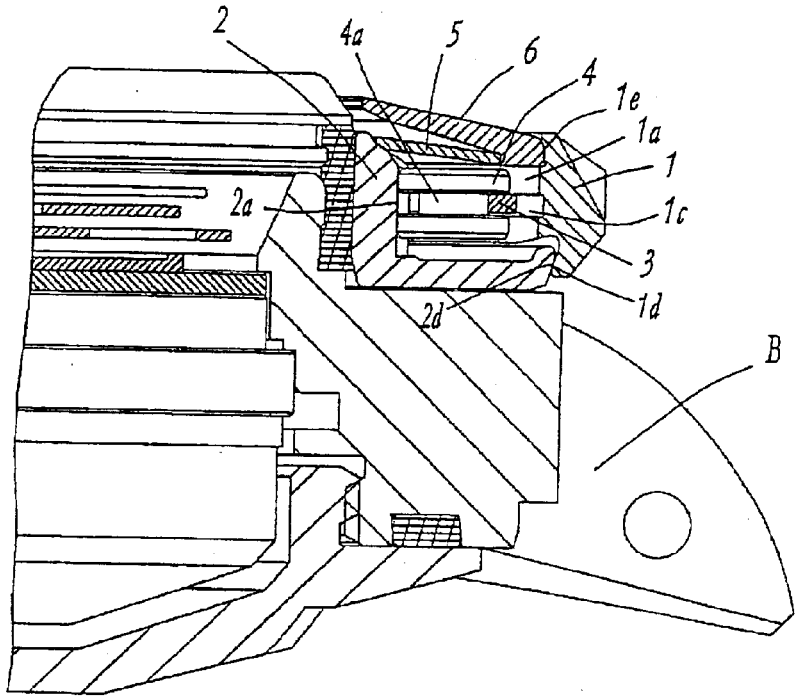
FIG. 3 is a view in section on III—III of FIG. 2.
Figure 4:
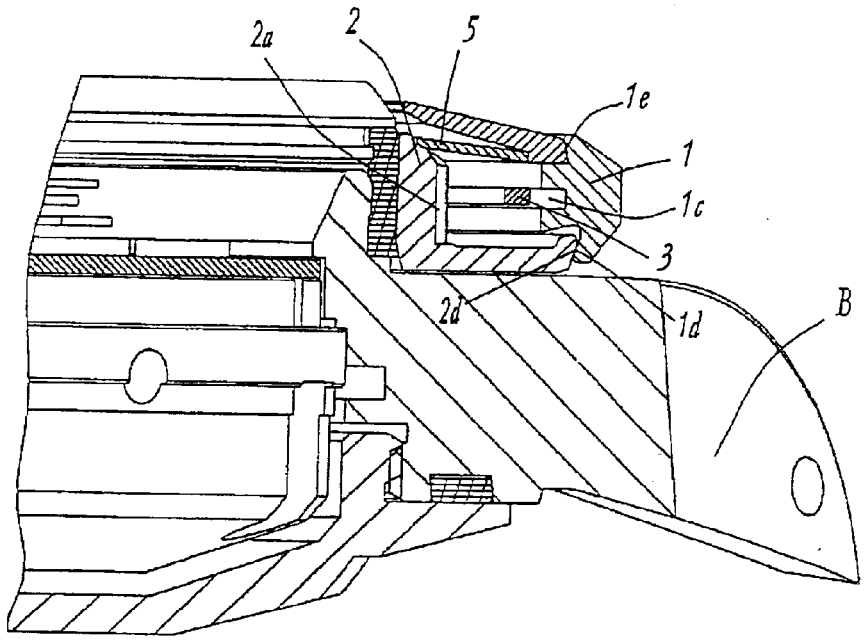
FIG. 4 is a view in section on IV—IV of FIG. 2.

The rotary bezel 1 is held on the ring 2 by two conical catches, one of them, 1*d*, formed on the rotary bezel 1 and the other, 2*d*, formed on the ring 2 and which are forcibly engaged in one another, as illustrated in FIGS. 3 and 4. To avoid any play between the rotary bezel 1 and the ring 2, these conical surfaces 1*d*, 2*d* are pressed together by a flat elastic annulus 5 the internal edge of which bears against the upper edge of the ring 2 and the external edge of which is trapped between an annulus 6 bearing indications intended to be moved angularly by the rotary bezel 1 and fixed in a catch 1*e* of this rotary bezel, as illustrated by FIGS. 3 and 4. This flat annulus 5 is deformed in its plane, adopting a frustoconical shape as illustrated, making it possible to press the two conical catches 1*d*, 2*d* against each other elastically. It is chosen that the strength of this axial elastic pressure be weak, which means that by pressing slightly on the rotary bezel 1 in order to turn it, this bezel is automatically shifted axially by a small distance, without this being perceived, making it possible to eliminate, or at the very least reduce greatly, the friction resulting from contact between the conical catches 1*d* and 2*d*.

As can be seen from the foregoing description, the three angular positioning rollers 4 associated with the closed-loop spring 3 allow perfect balancing of the positioning forces about the axis of rotation of the rotary bezel 1, and do so both when the rollers 4 are in the rest position in the fixed first angular positioning markings 2*a* of the ring 2, and when they are between two angular positions determined by these fixed angular positioning markings 2*a*, which means that the rotary bezel is never off-centered by the forces exerted by the closed-loop spring 3, 13, 23.

As a result, the friction that normally arises out of the off-centering of the rotary bezel under the effect of the positioning spring are avoided. This balancing of the forces on the axis of rotation of the rotary bezel is an essential characteristic of the invention that explains how the rotary bezel can be positioned with a force that holds it firmly in a position determined by the respective markings while at the same time, when this rotary bezel is moved angularly, giving a pleasant feel, combining firmness of positioning to smoothness of angular movement from one marking 2*a* to another.

Although the number of positioning rollers 4 in the example described is three and this represents the preferred embodiment of the invention, it would be possible to have just two diametrically opposed rollers 4. This choice may be preferable particularly where there is a desire to reduce the force needed to move the rotary bezel without at the same time reducing the size of the closed-loop spring 3.

Figure 5:
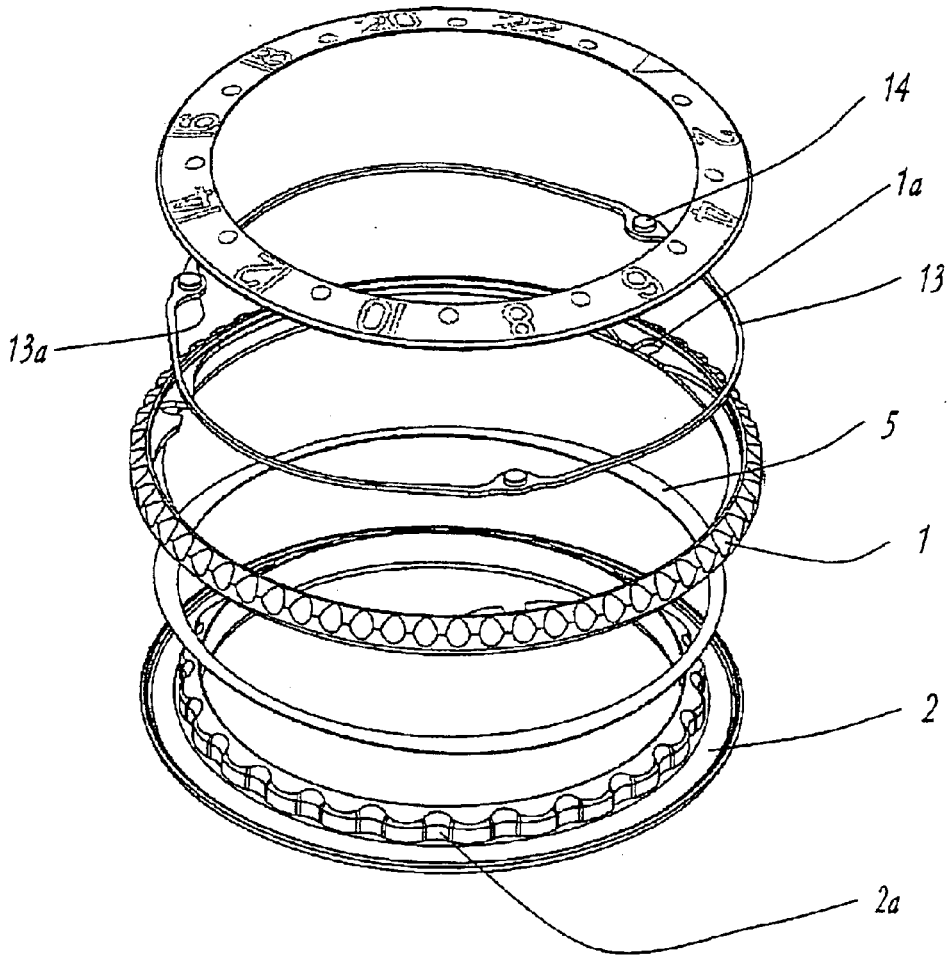
FIG. 5 is an exploded view of the elements of a case equipped with a rotary bezel, according to a second embodiment.
Figure 7:
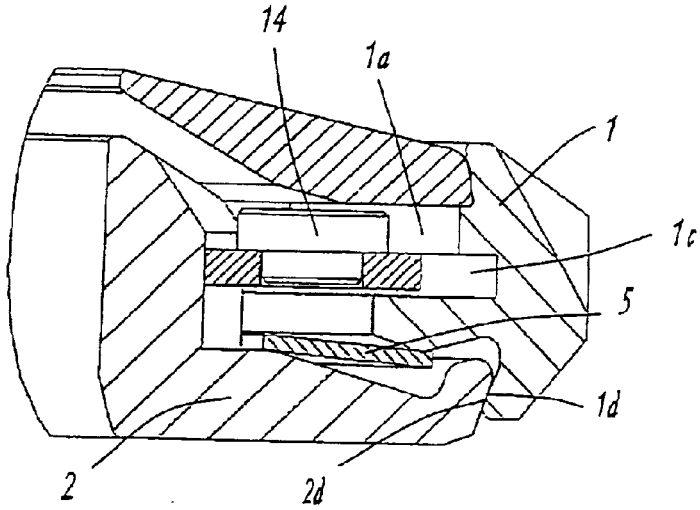
FIG. 7 is a view in section on V—V of FIG. 6.
Figure 6:
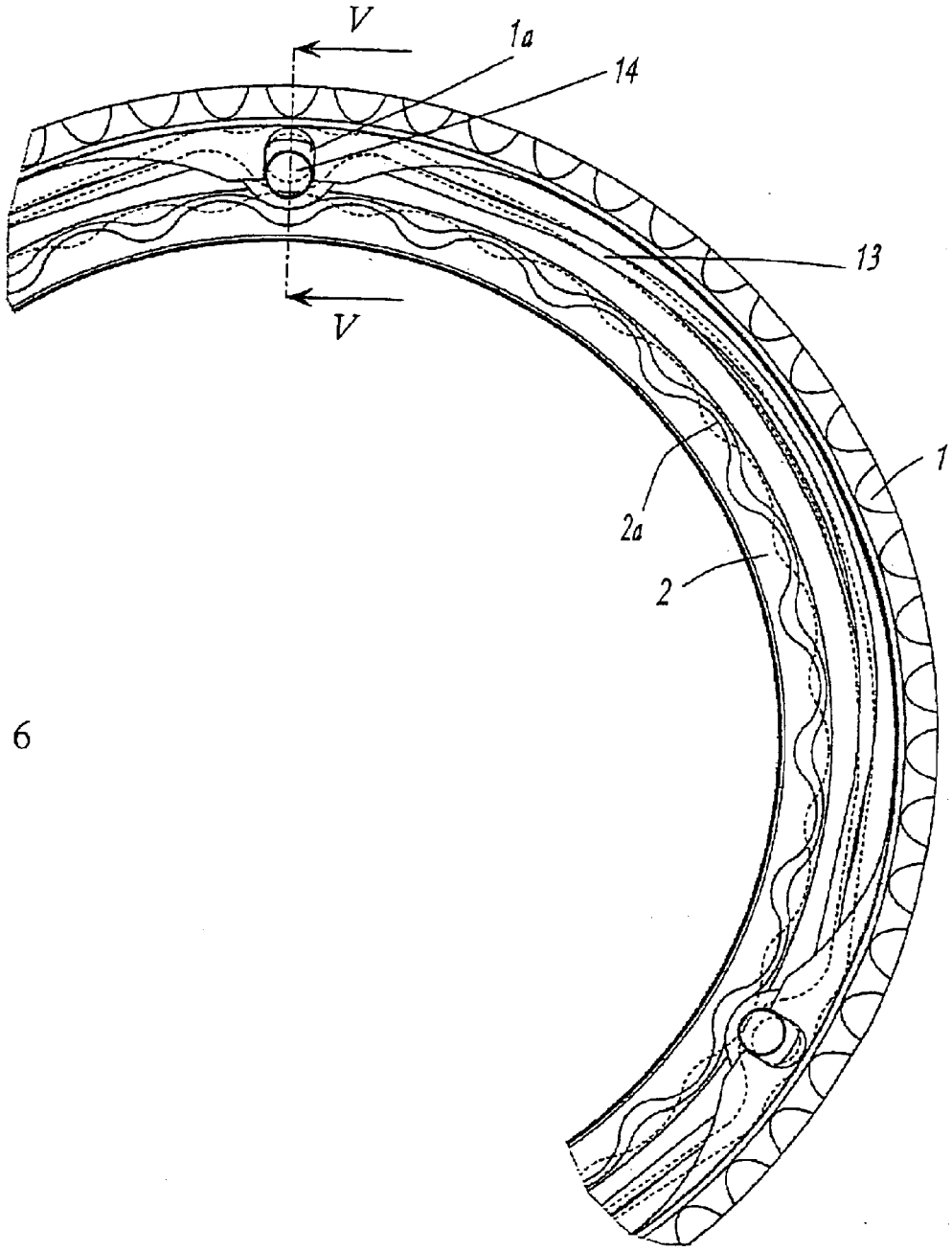
FIG. 6 is a partial plan view of the elements of FIG. 5 assembled, showing in chain line the bezel in a position that is intermediate between two determined positions.
Figure 8:
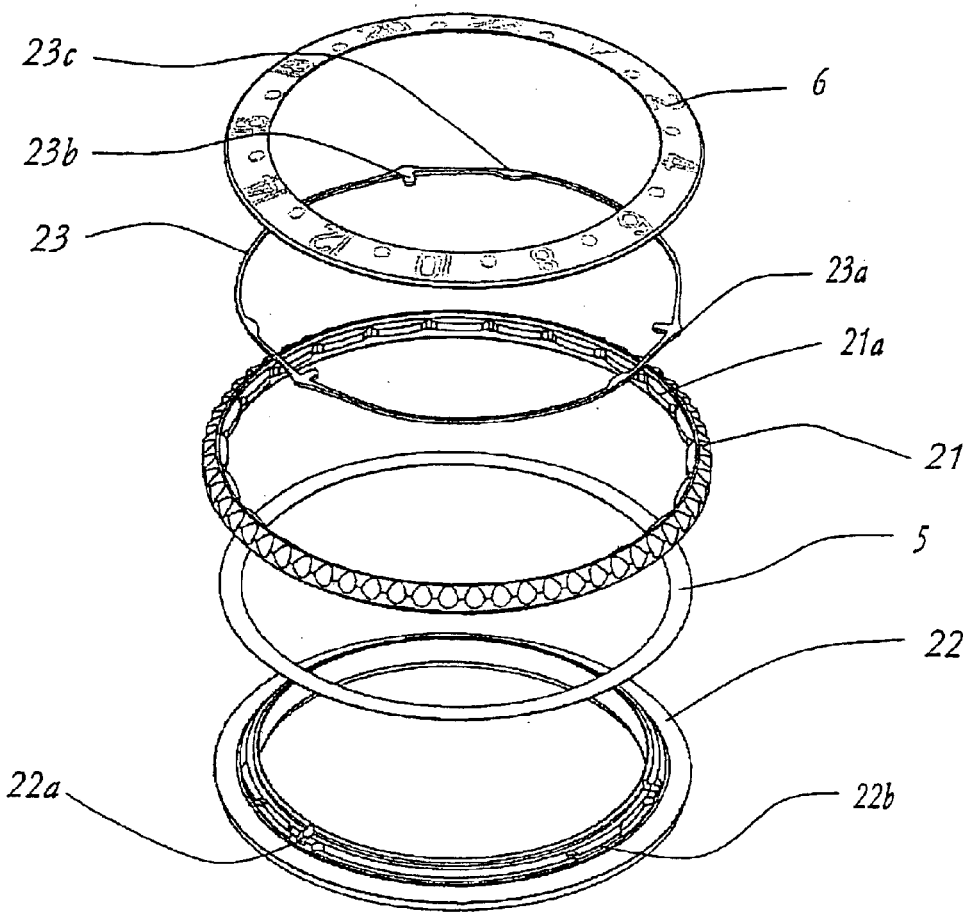
FIG. 8 is an exploded view of the elements of a watch case equipped with a rotary bezel according to a third embodiment.
Figure 10:
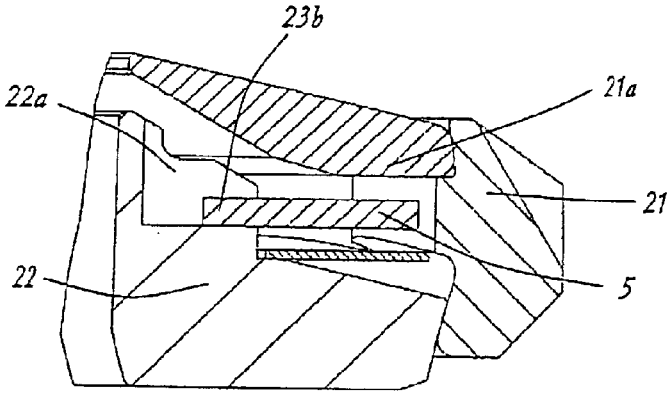
FIG. 10 is a view in section on X—X of FIG. 9.

The second embodiment illustrated by FIGS. 5 to 7 essentially differs from the first in that it is no longer rollers 4 that constitute the second positioning markings but three bulges 13*a* formed directly at the time of the cutting-out of the closed-loop spring 13, which engage in the angular positioning markings 2*a* of the ring 2. Radial guidance of the second markings formed by the bulges 13*a* is obtained by cylindrical guides 14 driven into openings cut at the center of the bulges 13*a*. These guides 14 are engaged in three slots 1*a* formed in three portions 1*b* which project into the rotary bezel 1 exactly like the rollers 4 of the first embodiment.

The rest of the rotary bezel mechanism is similar to the first embodiment. The position of the flat elastic annulus 5 which serves to press the two conical catches 1*d*, 2*d* against each other is changed in this embodiment, but its function remains the same.

In the case of the third embodiment illustrated in FIGS. 8 to 11, the positions of the first and second angular markings are reversed by comparison with the previous embodiments, that is to say that it is the rotary bezel 21 which exhibits the first angular positioning markings 21*a*, while the closed-loop spring 23 has a fixed angular position with respect to a ring 22 secured to the case middle B corresponding to the ring 2 of the previous embodiments. The outline of the closed-loop spring 23 in plan view is cut out to form three projections 23*a* spaced 120° apart, to constitute the second angular positioning markings intended to engage simultaneously in three of the first angular positioning markings 21*a* the number of which is a multiple of these second angular positioning markings 23*a*.

Each projection 23*a* is associated with a radial protrusion 23*b* centered on the same radius as each protrusion 23*a* and directed toward the inside of the closed-loop spring 23. Each of these radial protrusions 23*b* is mounted to slide radially in a radial guide slide 22*a* formed in the ring 22 driven onto the case middle B. The radial protrusions 23*b* have a rectangular cross section which means that they guide the spring 23 as it deforms as a result of the rotation of the rotary bezel 21 and they force the closed-loop spring 23 to deform in its plane.

The internal outline of the closed-loop spring 23 has three protrusions 23*c* which are engaged in three slots 22*b* formed in the external lateral face of the ring 22 so that the spring 23 is axially retained.

As can be seen from the three embodiments described, the spring 3, 13, 23 has a rectangular section the long side of which is arranged in the plane of the closed loops formed by these springs 3, 13, 23. Forces imparted to these springs in order to deform them in three radial directions are therefore directed in the plane of the loops formed by these springs 3, 13, 23 and therefore also parallel to the long sides of the sections of these springs. The advantage of such springs lies in the fact that they can be cut from steel sheet, allowing for optimum manufacture. These springs could, however, have a cross section of some different shape, square or circular, thus forming a toric spring.

Figure 2:
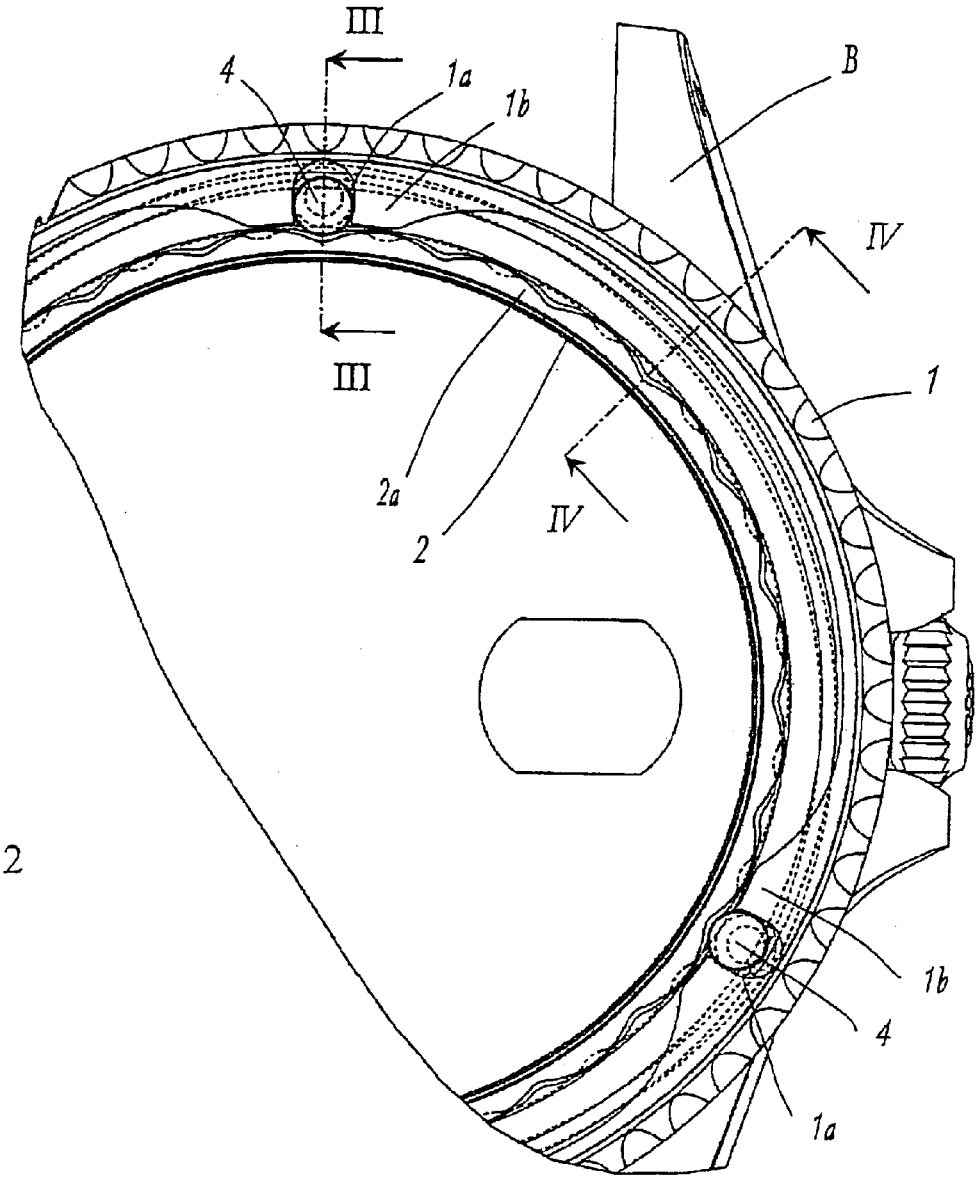
FIG. 2 is a partial plan view of the elements of FIG. 1 assembled, showing in chain line the bezel in a position that is intermediate between two determined positions.
Figure 9:
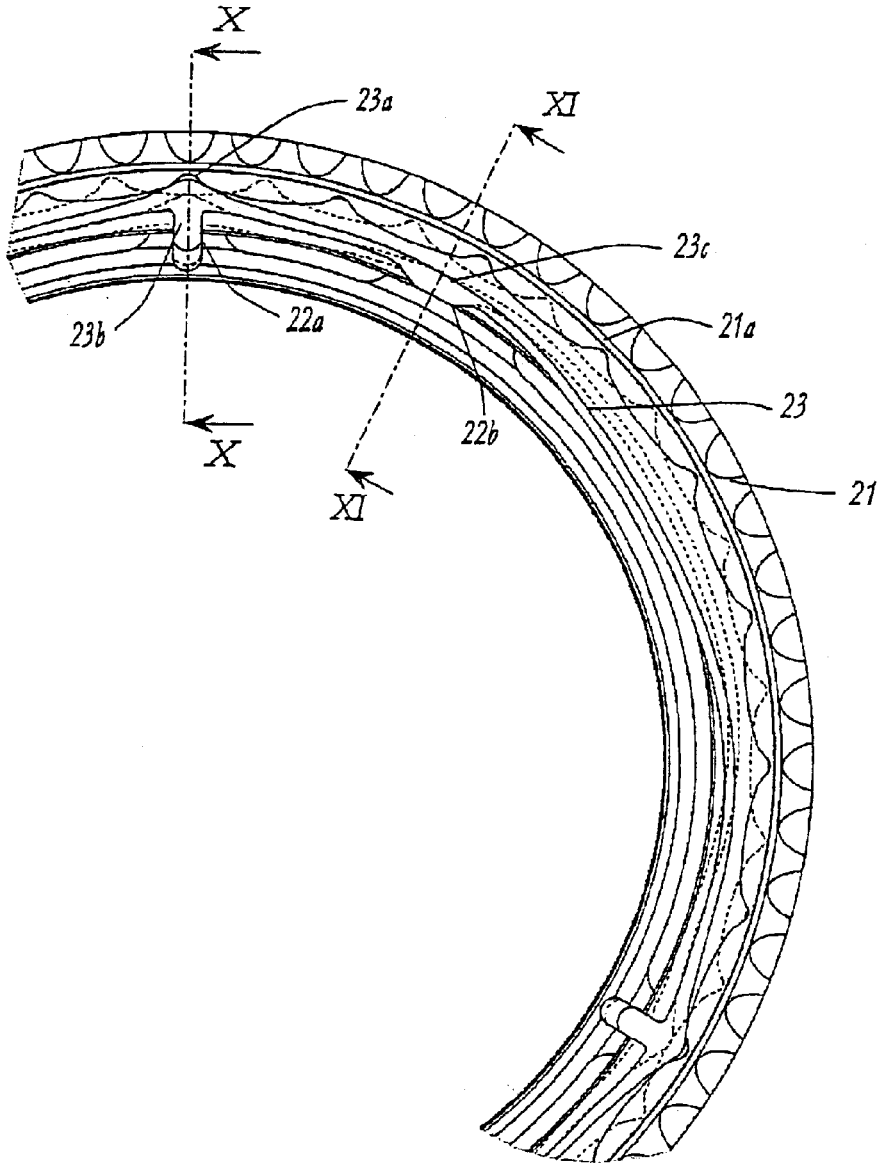
FIG. 9 is a partial plan view of the elements of FIG. 8 assembled, showing in chain line the bezel in a position that is intermediate between two determined positions.
Figure 11:
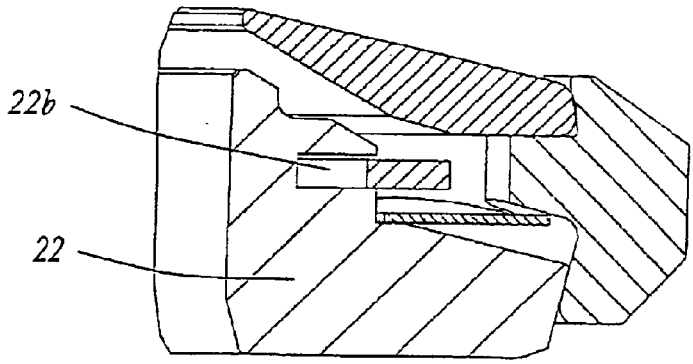
FIG. 11 is a view in section on XI—XI of FIG. 9.

These radial forces, also distributed about the axis of rotation of the rotary bezel 1, 21, cause, depending on whether they are directed toward the center or toward the periphery, that is to say depending on whether the forces involved are centripetal forces or centrifugal forces, either a lengthening by increase of the radius of curvature of the arcs of the spring segments 3, 13 situated between two adjacent positioning markings 4, 13*a* as illustrated by the intermediate positions illustrated in chain line in FIGS. 2 and 6 or a contraction under the effect of centripetal forces as in the case of the third embodiment in which the projections 23*b* tend to move closer together when moved toward the center of the bezel 21, as the deformation of the closed-loop spring 23 in chain line in FIG. 9 illustrates, this corresponding to an intermediate position of the bezel 21 between two markings 21*a*.

The shape of the spring 3, 13, 23 at rest, viewed in plan view, can range from a circle to a polygon with its sides and/or its vertices rounded or non-rounded. The number of second markings 4, 13*a*, 23*a* is at least three, but could be higher as the case may be. The number of first markings 2*a*, 21*a* is always a multiple of the number of second markings, so that all the second markings 4, 13*a*, 23*a* are simultaneously engaged with one of the first markings 2*a*, 21*a*.

Figure 12:
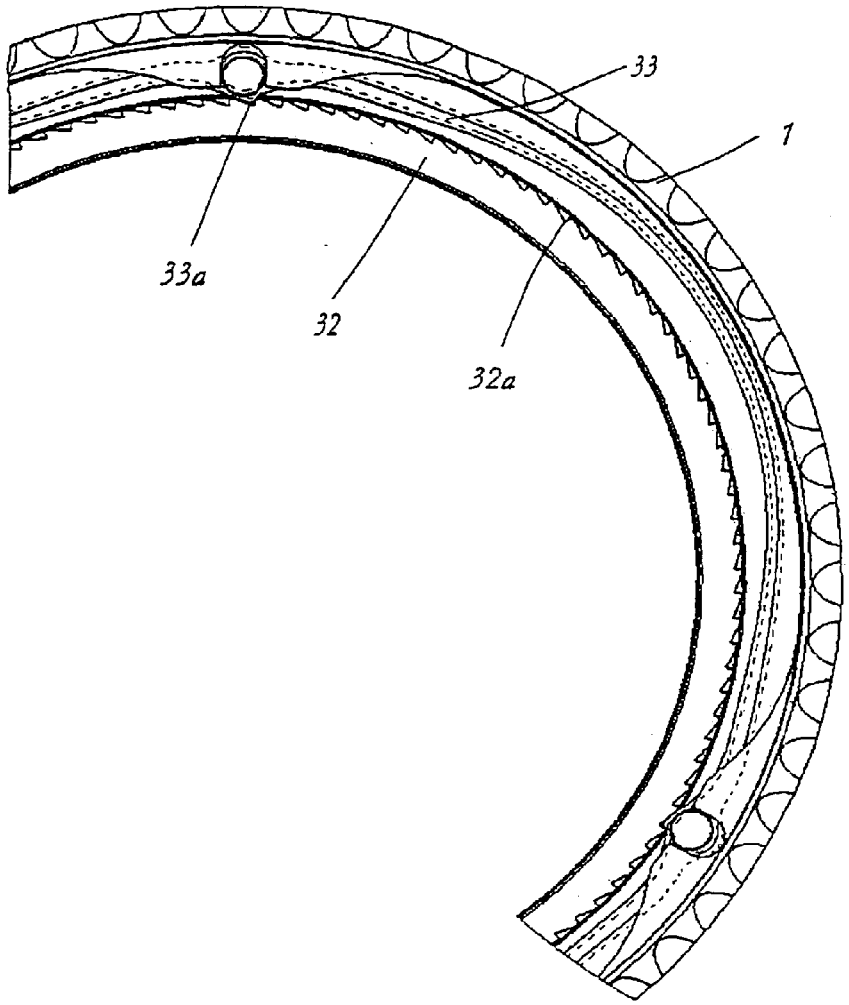
FIG. 12 is a partial plan view of an alternative form of the embodiment illustrated in FIG. 6.

Although one of the advantages of the embodiments described hitherto is that it makes it possible to have bezel-positioning forces that are equal regardless of the direction in which the bezel is rotated, the invention can be also be applied to a rotary bezel designed to rotate in just one direction of rotation. Such an alternative form is illustrated by FIG. 12.

The rotary bezel 1 is identical to that of the embodiments of FIGS. 1 to 7. What changes in this alternative form are the markings 32*a* formed on the ring 32, which are in the form of sawteeth, and the shape of the three bulges 33*a* of the closed-loop spring 33, which has a shape complementing the shape separating two sawtooth markings 32*a*, so as to engage with this tooth set 32*a* and thus allow the rotary bezel 1 to rotate only in the counterclockwise direction in the example illustrated by this variant. The other elements are in every respect the same as in the embodiment of FIGS. 5 to 7.

Figure 13:
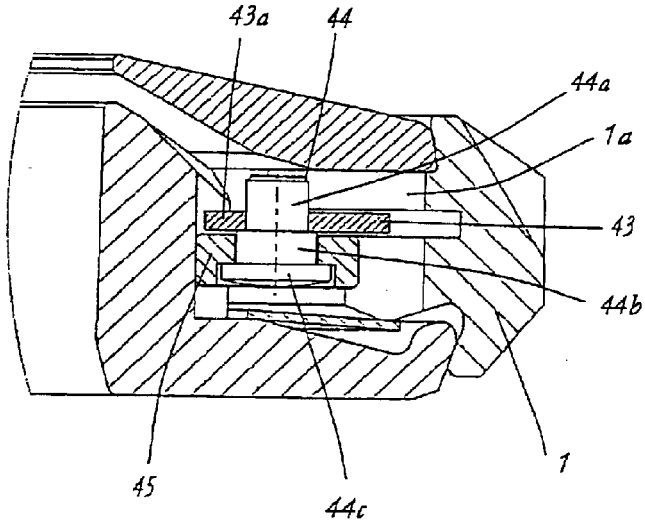
FIG. 13 is a sectioned view similar to FIG. 7 of another alternative form illustrated by the embodiment of FIGS. 5 to 7.

FIG. 13 illustrates another alternative form of the embodiment of FIGS. 5 to 7 in which the cylindrical guides 44 driven into openings cut at the center of the bulges 43*a* of the closed-loop spring 43 have three portions of increasing diameter 44*a*, 44*b*, 44*c*, one of them, 44*a*, driven into the opening of the spring 43, the next, 44*b*, acting as a pivot surface for a roller 45, while the third portion 44*c* acts as an axial stop to retain the roller 45. The three rollers 45 distributed angularly as described above engage with the markings 2*a* of the ring 2 and can be turned about the cylindrical guides 44 when the bezel 1 is made to rotate, driving along the spring 43, by virtue of the portions 44*a* of the cylindrical guides 44 engaged with the radial guide slides 1*a* of the bezel 1, identical to the bezel of FIGS. 1 to 4.

What is claimed is:

1. Watch case comprising a case middle, a rotary bezel, first and second angular positioning markings, one set secured to the rotary bezel and the other set to the case middle and elastic means tending constantly to place said first and second positioning markings in engagement with one another, the watch case wherein the first and second positioning markings are distributed evenly over 360° with respective numbers of spacings one of which is a multiple of the other which is at least equal to 2 and the respective outlines of which extend in a plane parallel to that of said bezel, radial guide being engaged with said markings having the smallest number of spacings, said elastic means having the form of a closed-loop spring associated with each of said markings engaged with said radial guide to simultaneously exert on these markings radial pressures directed toward said other markings and to subject said closed-loop spring to angularly distributed radial forces as said rotary bezel moves.

2. Watch case according to claim 1, in which said markings engaged with said radial guide consist of rollers each of which has a groove sized to accommodate a portion of said closed-loop spring.

3. Watch case according to claim 1 in which the outline of said closed-loop spring viewed in plan view is shaped to form said markings engaged with said radial guide, the radial axis passing through the center of each of said markings being coaxial with an element secured to said spring engaged with said radial guide.

4. Watch case according to claim 2 in which the outline of said closed-loop spring viewed in plan view is shaped to form said markings engaged with said radial guide, the radial axis passing through the center of each of said markings being coaxial with an element secured to said spring engaged with said radial guide.

5. Watch case according to claim 3 in which the outline of said closed-loop spring viewed in plan view is shaped to form said elements engaged with said radial guide.

6. Watch case according to claim 4 in which the outline of said closed-loop spring viewed in plan view is shaped to form said elements engaged with said radial guide.

7. Watch case according to claim 1 in which said closed-loop spring has a circular outline.

8. Watch case according to claim 2 in which said closed-loop spring has a circular outline.

9. Watch case according to claim 3 in which said closed-loop spring has a circular outline.

10. Watch case according to claim 4 in which said closed-loop spring has a circular outline.

11. Watch case according to claim 5 in which said closed-loop spring has a circular outline.

12. Watch case according to claim 6 in which said closed-loop spring has a circular outline.

13. Watch case according to claim 1 in which said closed-loop spring is axially retained by an annular slot formed in the bezel.

14. Watch case according to claim 2 in which said closed-loop spring is axially retained by an annular slot formed in the bezel.

15. Watch case according to claim 3 in which said closed-loop spring is axially retained by an annular slot formed in the bezel.

16. Watch case according to claim 4 in which said closed-loop spring is axially retained by an annular slot formed in the bezel.

17. Watch case according to claim 5 in which said closed-loop spring is axially retained by an annular slot formed in the bezel.

18. Watch case according to claim 6 in which said closed-loop spring is axially retained by an annular slot formed in the bezel.

19. Watch case according to claim 7 in which said closed-loop spring is axially retained by an annular slot formed in the bezel.

20. Watch case according to claim 8 in which said closed-loop spring is axially retained by an annular slot formed in the bezel.

21. Watch case according to claim 9 in which said closed-loop spring is axially retained by an annular slot formed in the bezel.

22. Watch case according to claim 10 in which said closed-loop spring is axially retained by an annular slot formed in the bezel.

23. Watch case according to claim 11 in which said closed-loop spring is axially retained by an annular slot formed in the bezel.

24. Watch case according to claim 12 in which said closed-loop spring is axially retained by an annular slot formed in the bezel.

25. Watch case according to one of claim 1 in which the internal outline of said closed-loop spring has projections that fit into slots formed on an internal lateral face integral with the case middle.

26. Watch case according to one of claim 2 in which the internal outline of said closed-loop spring has projections that fit into slots formed on an internal lateral face integral with the case middle.

27. Watch case according to one of claim 3 in which the internal outline of said closed-loop spring has projections that fit into slots formed on an internal lateral face integral with the case middle.

28. Watch case according to one of claim 7 in which the internal outline of said closed-loop spring has projections that fit into slots formed on an internal lateral face integral with the case middle.

29. Watch case according to claim 1, in which said closed-loop spring has substantially a polygonal outline.

30. Watch case according to claim 2, in which said closed-loop spring has substantially a polygonal outline.

31. Watch case according to claim 3, in which said closed-loop spring has substantially a polygonal outline.

32. Watch case according to claim 5, in which said closed-loop spring has substantially a polygonal outline.

33. Watch case according to claim 13, in which said closed-loop spring has substantially a polygonal outline.

34. Watch case according to claim 25, in which said closed-loop spring has substantially a polygonal outline.

* * * * *